US009156668B1

(12) United States Patent
Lindsey

(10) Patent No.: US 9,156,668 B1
(45) Date of Patent: Oct. 13, 2015

(54) BOTTLE CAP LIFTER

(76) Inventor: Kevin Shane Lindsey, Lake Oswego, OR (US)

( * ) Notice: Subject to any disclaimer, the term of this patent is extended or adjusted under 35 U.S.C. 154(b) by 865 days.

(21) Appl. No.: 13/183,321

(22) Filed: Jul. 14, 2011

Related U.S. Application Data

(60) Provisional application No. 61/364,140, filed on Jul. 14, 2010.

(51) Int. Cl.
*B67B 7/16* (2006.01)
*B67B 7/14* (2006.01)

(52) U.S. Cl.
CPC .... *B67B 7/16* (2013.01); *B67B 7/14* (2013.01)

(58) Field of Classification Search
CPC ..... B67B 7/12; B67B 7/16; B67B 7/14; B67B 7/403; B67B 7/44
USPC ..... 81/3.5, 3.55, 3.27, 3.57; 7/151
See application file for complete search history.

(56) References Cited

U.S. PATENT DOCUMENTS

| | | | | | |
|---|---|---|---|---|---|
| 952,085 | A | | 3/1910 | Stephens | |
| 1,007,502 | A | * | 10/1911 | Stephens | 81/3.09 |
| 1,267,052 | A | * | 5/1918 | Burnett | 7/151 |
| 1,709,669 | A | | 4/1929 | Jones | |
| 1,994,215 | A | * | 3/1935 | Gaunt | 30/155 |
| 2,188,352 | A | | 1/1940 | Hothersall | |
| 2,257,532 | A | | 9/1941 | Perocco | |
| 2,625,847 | A | | 1/1953 | Frazier | |
| 2,734,204 | A | | 2/1956 | Epstein | |
| 2,801,557 | A | * | 8/1957 | Belpedio | 81/3.08 |
| 4,207,781 | A | * | 6/1980 | Greenwood | 81/3.55 |
| 4,327,490 | A | * | 5/1982 | Hoskins | 30/408 |
| 4,433,597 | A | | 2/1984 | Rowland | |
| D281,572 | S | | 12/1985 | Gabriel et al. | |
| D293,198 | S | | 12/1987 | Schumacher et al. | |
| 4,723,465 | A | * | 2/1988 | Hughes | 81/3.09 |
| 4,979,407 | A | * | 12/1990 | Hernandez et al. | 81/3.09 |
| 5,265,501 | A | | 11/1993 | Reyes | |
| D347,456 | S | | 5/1994 | Wire | |
| D348,773 | S | | 7/1994 | Kutzera | |
| 5,644,848 | A | | 7/1997 | Totten | |
| D383,045 | S | | 9/1997 | Turso | |
| 6,105,468 | A | * | 8/2000 | Fohrman et al. | 81/3.09 |
| D497,088 | S | | 10/2004 | Davis | |
| 6,860,397 | B1 | * | 3/2005 | Walters, Jr. | 215/305 |
| D557,577 | S | | 12/2007 | Huang | |
| D644,075 | S | | 8/2011 | Barnett | |

* cited by examiner

*Primary Examiner* — Hadi Shakeri
*Assistant Examiner* — Danny Hong
(74) *Attorney, Agent, or Firm* — Klarquist Sparkman, LLP

(57) ABSTRACT

A bottle cap lifter includes a body with a bottle cap receiving recess and a lever portion pivoted to the body. When moved to the open position, the bottle cap on a bottle is insertable in the recess into a position for engagement by a distal end portion of the lever such that the lever can apply a lifting force to the bottle cap to remove the bottle cap from the bottle.

23 Claims, 4 Drawing Sheets

BOTTLE CAP LIFTER

CROSS REFERENCE TO RELATED APPLICATION

This application claims the benefit of U.S. Provisional Application Ser. No. 61/364,140, entitled COIN SIZED FOLDING BOTTLE CAP LIFTER, filed on Jul. 14, 2010.

FIELD

This application relates to devices for removing bottle caps from bottles.

BACKGROUND

Devices for opening bottle caps have been around for some time. Examples include the devices of U.S. Pat. No. 2,257,532 and U.S. Pat. No. 2,734,204. Despite the existence of such devices, a need exists for an improved bottle cap opener for removing bottle caps from capped bottles.

SUMMARY

Disclosed herein are a number of embodiments of bottle cap lifter devices for removing bottle caps from bottles. The invention encompasses all new and non-obvious aspects of bottle cap lifters disclosed herein, both alone and in sub-combinations and combinations with one another. Although desirable, all features of an embodiment are not required to be included in a bottle cap lifter device to fall within the scope of the invention disclosed herein. In addition, it is not required that an embodiment incorporate plural advantageous features disclosed herein or meet plural objectives of bottle cap lifter designs disclosed herein.

In accordance with this disclosure, bottle cap lifters are disclosed for use in removing bottle caps from bottles such as beverage containers. Desirably the bottle cap lifters can be of small compact size so that they can easily be transported within a user's pocket. In addition, it is also desirable that the bottle cap lifters lack exposed sharp edges that can snag on clothing, for example, if carried in a user's pocket. Components of bottle cap lifters in accordance with this design have exposed surfaces on which advertising and/or other messaging can be provided. Embodiments of bottle cap lifters as disclosed herein are simple to use and provide entertainment when used. In addition, these bottle cap lifters can be manually manipulated and can provide stress relief by allowing this manipulation.

In accordance with one specific embodiment, a bottle cap lifter comprises a body portion and a lever portion pivoted to the body portion to permit relative rotation of these portions with the lever portion acting as a catch and lever during removal of the bottle cap. A recess or void is provided in one surface of the body that faces the lever portion when the lever portion is pivoted to a closed position. When the lever is pivoted to an open position, a projecting distal end portion of the lever is positioned such that a bottle cap can be inserted in the recess for engagement by the distal end portion of the lever so that exertion of force on the lever lifts the bottle cap from the bottle. The recess can be bounded by a peripheral rim of the body. The peripheral rim can be flat or planar. In addition, the surface of the lever facing the peripheral rim when the lever is in a closed position can also be flat or planar with these surfaces sliding relative to one another as the lever is pivoted to open and closed positions.

In accordance with an embodiment, a bottle cap lifter is disclosed for lifting a bottle cap from a bottle, the bottle cap having an exposed surface and a peripheral bottle cap edge. The bottle cap lifter can comprise a body comprising a first body surface with a peripheral rim bounding at least a portion of a recess, the recess extending into the first body surface. The body can also comprise a second body surface opposed to the first body surface. The bottle cap lifter of this embodiment further comprises a lever including first and second lever end portions and first and second opposed lever surfaces, the first lever end portion comprising a distal end. The lever can be pivoted to the body at a location adjacent to the first lever end portion and spaced from the distal end of the first lever end portion such that the lever is pivotal about a pivot axis between a first lever position and plural second lever positions. In the first lever position at least a portion of the second lever end portion is overlaid by the first body surface, and wherein in a second lever position said at least a portion of the second lever end portion extends outwardly from the body and a bottle cap engaging portion of the first lever end portion overlays a portion of the recess. As a result, the bottle cap engaging portion of the first lever end portion is positioned to engage a portion of the peripheral bottle cap edge when the bottle cap is inserted into the recess and between the first body surface and the bottle cap engaging edge portion with a portion of the peripheral rim engaging the exposed surface of the bottle cap.

As a further aspect of an embodiment, the peripheral rim can be planar and the first lever surface can be planar. Also, the peripheral rim and first lever surface can face one another when the lever is in the first lever position. The first lever surface and peripheral rim can be planar surfaces that slide relative to one another as the lever is pivoted. The first lever surface and peripheral rim can abut one another when the lever is in the first position.

As another aspect of an embodiment, the first lever surface can entirely cover the recess and engage the peripheral rim when the lever is in the first position.

As yet another aspect of an embodiment, the body and lever can be sized such that the bottle cap engaging portion of the first lever end portion and the portion of the peripheral rim furthest from the lever are on opposite sides of a longitudinal center line of the bottle.

As a further aspect of an embodiment, the recess can comprise a hollow interior portion of the body and the lever can comprise a cover sized to cover and entirely close the recess when the lever is in the first position.

As another aspect of an embodiment, the lever can comprise a planar plate with the first lever surface having the same area and shape as the first body surface.

As a further aspect of an embodiment, the pivot axis can be perpendicular to the first lever surface.

As yet another aspect of an embodiment, the body and lever can be pivoted together by a rivet or an eyelet. Also the body and lever can each comprise a respective opening, with the openings being aligned with one another and with a pivot axis about which the lever pivots relative to the body portion. In addition, the rivet can be hollow and open at each end such that an elongated component, such as a keychain, is insertable through the opening of the body, the rivet and the opening of the lever.

In accordance with an embodiment of a bottle cap lifter for lifting a bottle cap from a bottle, the bottle cap having an exposed surface and a peripheral bottle cap edge, the bottle cap lifter can comprise a body portion comprising a first body surface including a peripheral body edge portion and the first body surface can comprise a bottle cap receiving recess. Also, the bottle cap lifter can comprise a lever comprising first and second lever end portions and a first lever surface extending between the first and second lever end portions. The lever can be pivoted to the body for pivoting about a first pivot axis between first and second lever positions. The pivot axis can be perpendicular to the first lever surface. In the first lever position, the lever can be positioned such that the first lever surface is substantially overlaid by the first body surface. In the second lever position, the lever can be positioned such that the second lever end portion projects outwardly from the body and a bottle cap engaging portion of the first lever end portion overlays a portion of the bottle cap engaging recess. As a result, an edge of a bottle cap is insertable into the recess such that the cap engaging portion of the first lever end portion catches a portion of the bottle cap edge and a portion of the peripheral body edge portion engages the exposed surface of the bottle cap such that the application of force by the cap engaging edge portion to the caught edge of the bottle cap lifts the bottle cap from the bottle.

As another aspect of an embodiment, the first lever surface and peripheral body edge portion can be planar surfaces that slide relative to one another as the lever is pivoted. Also, the first lever surface can entirely cover the recess and engage the peripheral body edge portion when the lever is in the first position. The body and lever desirably can lack any pointed surfaces that could snag clothing of a user.

As a further aspect of an embodiment, the recess can comprise a hollow interior portion of the body and the lever can comprise a cover sized to cover and entirely close the recess when the lever is in the first position.

As a further aspect of an embodiment, the body and lever can be pivoted together by a rivet, which can be a hollow tubular eyelet member. The body and lever each can comprise a respective opening aligned with the rivet. The rivet can be hollow and open at each end such that an elongated component, such as a keychain, is insertable through the opening through the body, the rivet and through the opening through the lever.

The foregoing and other objects, features, and advantages of the invention will become more apparent from the following detailed description, which proceeds with reference to the accompanying figures.

DETAILED DESCRIPTION

Throughout this disclosure, when a reference is made to a first element being coupled to a second element, the term "coupled" is to be construed to mean both direct connection of the elements as well as indirect connection of the elements by way of one or more additional intervening elements. Also, the singular terms "a", "and", and "first", mean both the singular and the plural unless the term is qualified to expressly indicate that it only refers to a singular element, such as by using the phase "only one". Thus, for example, if two of a particular element are present, there is also "a" or "an" of such element that is present. In addition, the term "and/or" when used in this document is to be construed to include the conjunctive "and", the disjunctive "or", and both "and" and "or". Also, the term "includes" has the same meaning as comprises.

Figure 1:
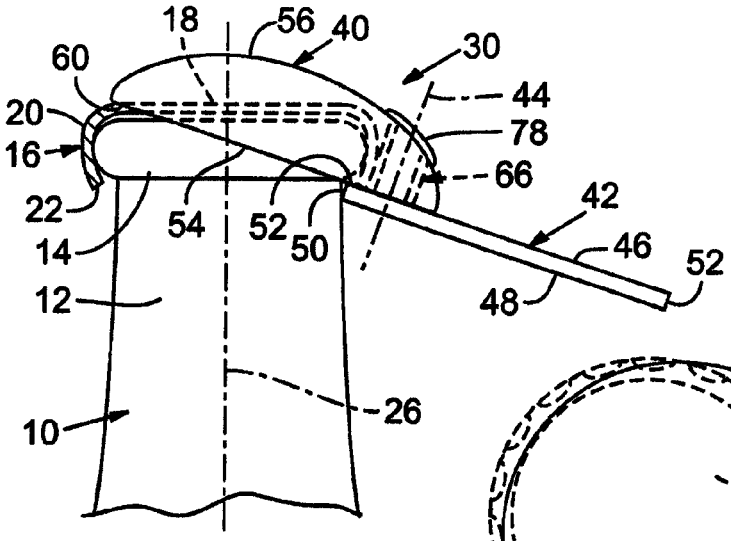
FIG. 1 is a side elevational view of one embodiment of a bottle cap lifter in accordance with this disclosure in a position to lift a bottle cap from a bottle.
Figure 2:
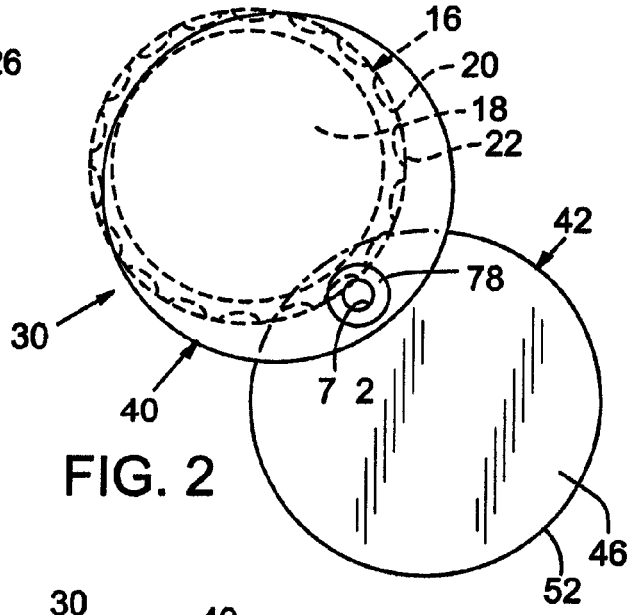
FIG. 2 is a top view of the embodiment of a bottle cap lifter shown in FIG. 1.

With reference to FIG. 1, a bottle 10 is shown having a neck 12 and an enlarged rounded annular cap receiving end portion 14. A bottle cap 16 is shown mounted to end portion 14 of the bottle with an upper bottle cap surface 18 that is exposed. The cap 16 also comprises an annular side wall 20 and a lower edge 22 that can be engaged by a bottle lifter for removing the cap as explained below. The illustrated bottle 10 also has a longitudinal center line 26 shown extending upwardly when the bottle is in an upright orientation as shown in FIG. 1.

One form of a bottle cap lifter 30 is shown in FIGS. 1-5. The illustrated bottle cap lifter 30 is of an extremely pleasing ornamental appearance. The functioning of the bottle cap lifter as described below can be accomplished with designs that look very different from the design depicted in FIGS. 1-5.

Figure 3:
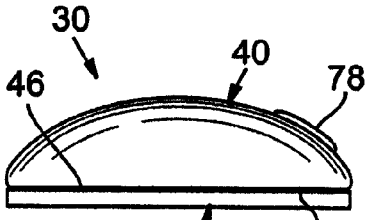
FIG. 3 is a side elevational view of one embodiment of a bottle cap lifter showing a lever portion in one completely folded position.

The illustrated bottle cap lifter 30 comprises a body portion or body 40 and a lever portion or lever 42. The body 40 and lever 42 are pivoted together for pivoting about a pivot axis such as pivot axis 44 (FIG. 5) between a closed position and one or more open positions. An exemplary closed position is shown in FIG. 3. In FIG. 3, the lever 42 covers or overlies the body 40. In this description it is to be understood that terms such as overlie and upper or lower are relative terms depending upon the orientation of the bottle cap lifter. The lever 42 comprises opposed upper and lower major surfaces 46, 48 and first and second end portions 50, 52. The pivot axis 44 is positioned spaced from the distal end 50 of the lever such that the lever comprises a catch or bottle cap engaging surface 52 that can be positioned to engage the edge 22 of the bottle cap when the bottle cap and bottle is positioned within the bottle cap lifter as shown in FIG. 1 with the lever in one of its extended positions. The bottle cap lifter has a first surface 54 that faces the surface 46 of the lever and an exposed exterior surface 56 to which advertising or other messages can be etched or otherwise affixed or printed thereon. A recess is provided into the surface 54 (see, for example, recess 58 in FIG. 5) to provide a space within which the bottle cap can be inserted as shown in FIG. 1.

In FIG. 1, the pivot axis 44 is shown perpendicular to the surface 46 of the lever 42. In addition, the surface 54 of body 40 can comprise, at least in part, a peripheral rim that bounds at least a portion of the recess 58. In one form, the rim can comprise an annular surface 60 (see FIG. 5) although the rim 60 can be of other shapes. The body 40 and lever 42 can be pivoted together in any convenient manner. In one desirable approach, a rivet 66 is used for this purpose. It is to be understood in this disclosure that the term "rivet" is to be broadly construed to include other forms of pivot pins or structures.

As can be seen in FIG. 1, the portion of the rim 60 that engages the bottle cap opposite to the distal end 50 of the lever can be positioned on the opposite side of the longitudinal center line 26 of the bottle cap from the portion of the bottle cap edge 22 engaged by the distal end surface 52.

Figure 4:
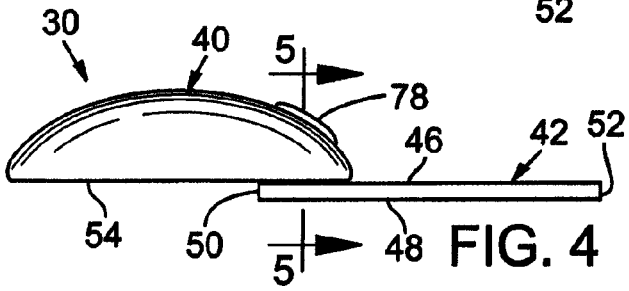
FIG. 4 is a side elevational view of the embodiment of a bottle cap lifter of FIG. 3 with a lever portion in a fully extended position.
Figure 5:
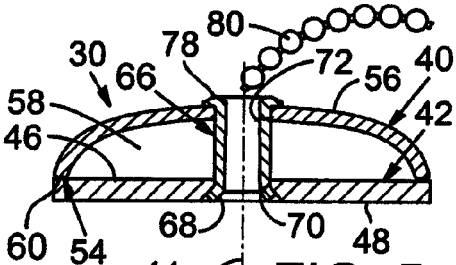
FIG. 5 is a vertical sectional view taken along line 5-5 of FIG. 4 illustrating one form of a pivot that can be used in the embodiment of FIG. 1.
Figure 5A:
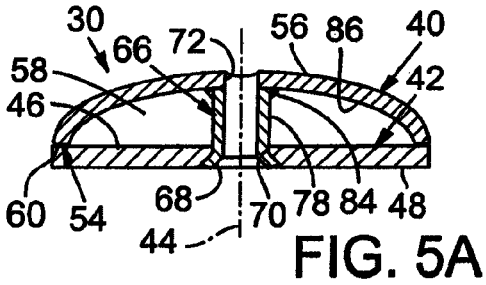
FIG. 5A is similar to FIG. 5, but illustrating an alternative form of pivot that can be used in the embodiment of FIG. 1.

With reference to FIG. 5, an optional opening 70 is shown through the lever 42 and another optional opening 72 is shown through the body 40. The openings 70 and 72 are aligned with the pivot axis 44. The rivet 66 extends through these openings. In FIG. 5, one end portion 68 of the rivet can be recessed into lever 48 with the opening 70 being shaped to accommodate the rivet end portion 68. As shown in FIG. 5, in this example the rivet end portion 68 is enlarged to prevent it from passing through the opening through the lever 42. The upper end portion 78 of the rivet can extend through the body opening and be flared to engage the outer surface 56 of the body 40. The rivet 66 can comprise a hollow eyelet type rivet through which an elongated member, such as a keychain 80, can be inserted with the keychain passing through opening 72, the interior of the rivet 66 and the opening 70. In an alternative construction, the upper end portion 78 of the rivet 66 does not pass through the opening of the body 40. Instead, the upper end of the rivet is secured, as by weld 84, to the interior surface 86 of the body 40. In both the embodiments of FIGS. 5 and 5A (and also of FIGS. 1-4), sharp edges have been eliminated. This facilitates storage of the bottle cap lifter in, for example, a user's pocket while minimizing the possibility of the lifter snagging the user's clothing.

With further reference to FIGS. 1-4, the illustrated aesthetically pleasing form of the bottle lifter of these figures has a hemispherical dome-like body portion 40 and a planar disc lever 42 that is of a circular shape. In addition, both of the surfaces 46, 48 of the lever can be planar or flat as can the rim 60 of the body 40. As the lever is pivoted between open and closed positions and vice versa, the surface 46 and the surface 54 slide relative to one another.

As can be seen in FIG. 3, with the illustrated configuration, when in a closed position, the surfaces 46 and 54 overlay one another. In this embodiment, the surfaces abut one another when in this position. In addition, the surface 46 can be of the same (which includes substantially the same) cross-sectional area and shape as the surface 54 so that, when the bottle cap lifter is in the closed position, the lever does not project significantly outwardly beyond the peripheral edges of the body 40. This construction can be varied, for example, by putting a notch in one or both of these members to facilitate gripping of these members, the illustrated construction makes for an extremely compact bottle cap lifter. FIG. 4 illustrates the lever 42 shifted to an open position. In its most fully open position, the lever ends 50, 52 are 180 degrees from the position shown in FIG. 3. However, intermediate open positions wherein the end portion 52 of the lever is not fully open, but extends outwardly beyond the periphery of the body, are also possible.

It should be noted that even though in FIGS. 1-4 the lever 42 is shown as a circular disc, the term "end portion" can be applied to this lever with one end being closest to the pivot axis 44 and the opposite end being furthest from the pivot 44. That is, the term "end portion" is to be broadly construed to exist even in the case of a circular lever.

In the embodiment of FIGS. 1-5, the rivet 66 permits 360 degree rotation of the lever 42 relative to the body 40 in either direction. Alternatively, one can include a stop or other feature to limit the extent of pivoting of the lever in one direction.

Figure 6:
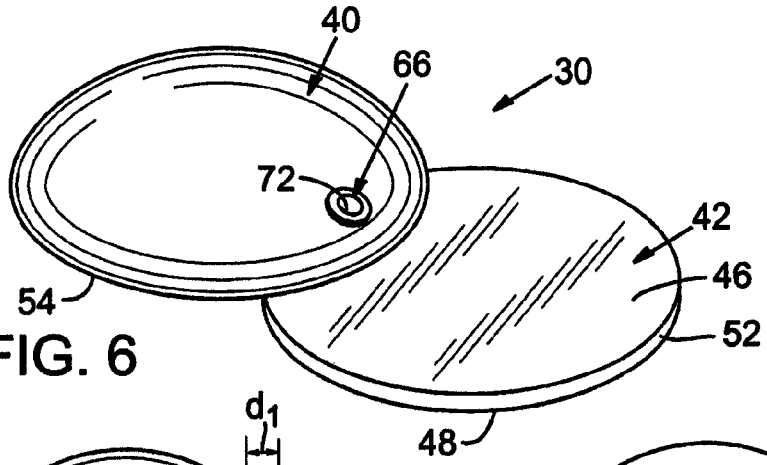
FIG. 6 is a perspective view of the embodiment of a bottle cap lifter of FIG. 1.
Figure 6A:
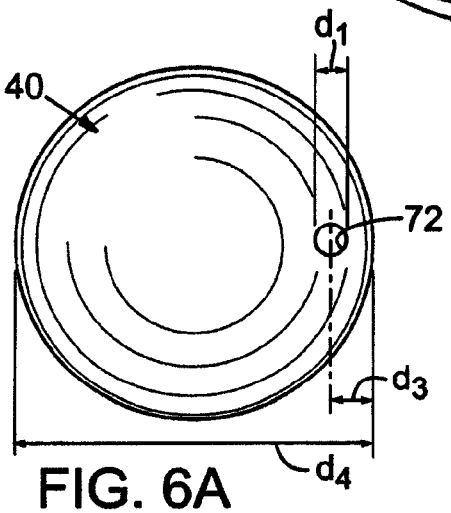
FIG. 6A is a top view of the bottle cap lifter of FIG. 6 with a lever portion positioned beneath a body or top portion of the bottle cap lifter.
Figure 6B:
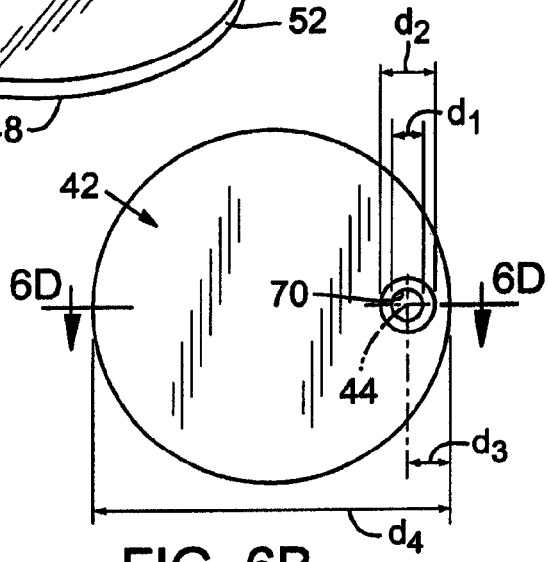
FIG. 6B is a bottom view of the bottle cap lifter of FIG. 6 with the top or body portion of the bottle cap lifter covered by the lever portion.
Figure 6C:
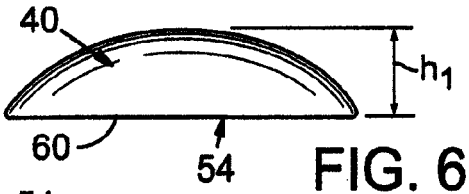
FIG. 6C is a side elevational view of the top or body portion of the bottle cap lifter of FIG. 6.
Figure 6D:
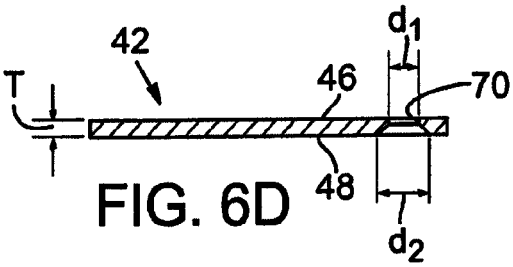
FIG. 6D is a vertical sectional view through a lever portion of the embodiment of the bottle cap lifter of FIG. 6.
Figure 6E:
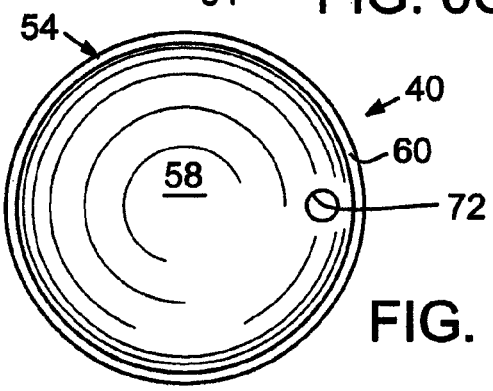
FIG. 6E is a bottom view of the top or body portion of the bottle cap lifter of FIG. 6.
Figure 7:
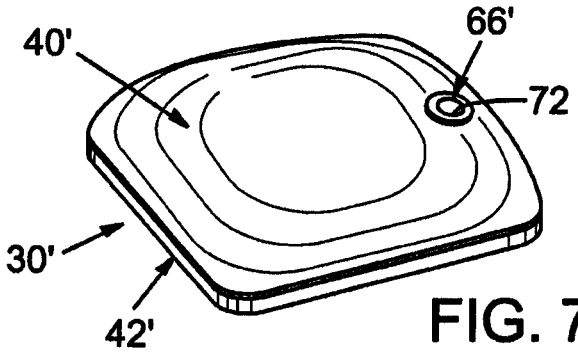
FIG. 7 is a perspective view of an alternative form of bottle cap lifter in accordance with this disclosure.
Figure 8:
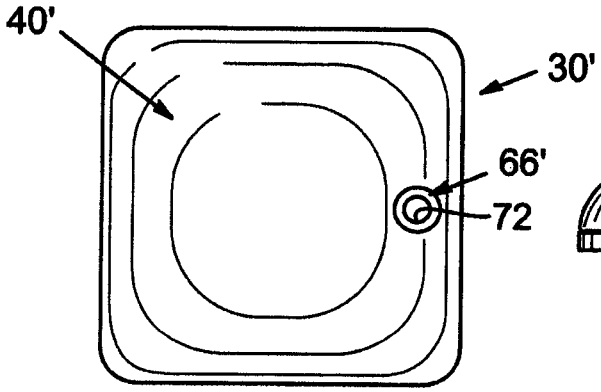
FIG. 8 is a top view of the bottle cap lifter of FIG. 7.
Figure 9:
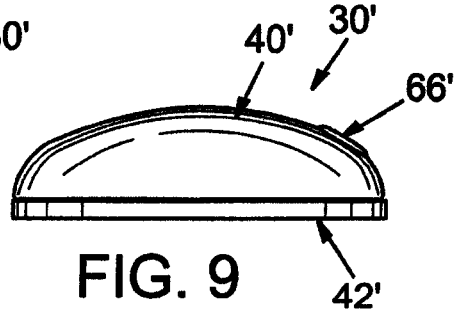
FIG. 9 is a side elevational view of the bottle cap lifter of FIG. 7, it being understood that the views from the other sides of this embodiment are the same as shown in FIG. 9.
Figure 10:
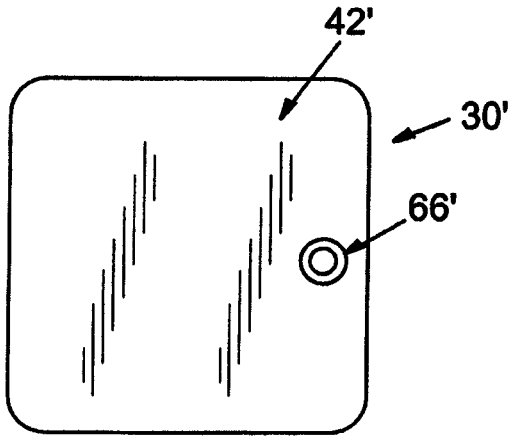
FIG. 10 is a bottom view of the bottle cap lifter of FIG. 9.

FIG. 6 is a perspective view of the embodiment of FIG. 1 to provide another view of this embodiment looking generally downwardly toward the body 40.

FIGS. 6, 6A, 6B, 6C, 6D and 6E illustrate the body 40 with exemplary dimensions as follows: $d_1$, the diameter of the opening 72 through the body being 0.125 inch; $d_3$, the distance from the pivot axis 44 to the nearest edge of the body in a plane containing the rim of the body being 0.2235 inch; and the height $h_1$ of the body being 0.235 inch. Exemplary dimensions of the lever include a diameter $d_4$ of 1.0781 inch, the distance $d_1$ being the diameter of a central portion of the opening 70 being 0.125 inch, the distance $d_2$ being the diameter of the widest portion of the opening 70 being 0.1875 inch and the distance from the pivot axis 44 to the adjoining nearest edge of the lever $d_3$ being 0.160 inch. In addition, the thickness T of the lever is 0.050 inch. Thus, the cross-sectional area of an exemplary bottle cap opener is smaller in cross-sectional dimension than a currently being minted half dollar coin. These dimensions are exemplary and can be varied but do illustrate the compact form of bottle cap opener in accordance with certain desirable embodiments of this disclosure that can be easily carried in a user's pocket.

FIGS. 7-10 illustrate respective perspective, top, side elevation and bottom views of an alternative form of bottle cap lifter to the form shown in FIGS. 1-5. In the embodiment of FIGS. 7-10, components in common with those of FIGS. 1-5 have been assigned the same numbers but with a prime (') to indicate their different form. In the embodiment of FIGS. 7-10, the lever portion 42' is shown in a closed position. The lever 42' can be pivoted to one or more open positions such as shown in FIG. 1 of the previously discussed embodiment. In addition, a bottle cap accommodating recess or void is provided in the underside of the body 40' to accommodate the edge of a bottle cap when the bottle cap is inserted for lifting off of a bottle by the lever with the distal end of the lever engaging the edge of the bottle cap.

FIGS. 11-17 illustrate yet another form of bottle cap lifter in accordance with this disclosure. In this embodiment, elements in common with the embodiment of FIGS. 1-5 have been given the same number with a double prime (''). Again, for convenience, the lever portion 42'' has been shown in closed position. When open, the lever 42'' is pivoted to extend away from the body with a distal end portion of the lever in position to engage the edge of a bottle cap inserted into a recess on the underside of body 40'' in the same manner as described above in connection with FIGS. 1-5.

Figure 11:
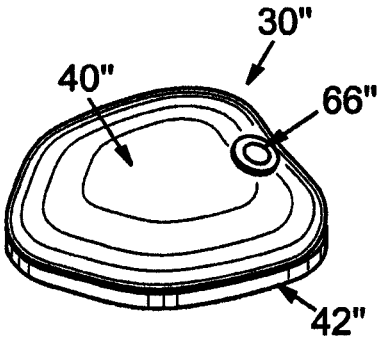
FIG. 11 is a perspective view of an alternative form of bottle cap lifter in accordance with this disclosure and with a lever portion shown in a closed position.
Figure 12:
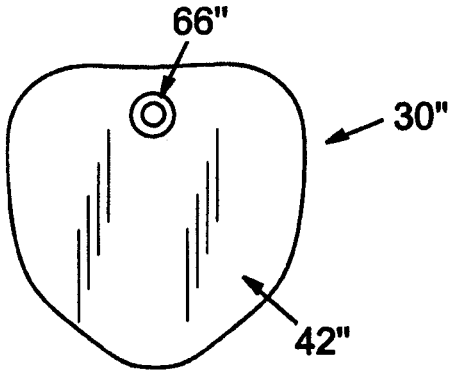
FIG. 12 is a bottom view of the bottle cap lifter embodiment of FIG. 11.
Figure 14:
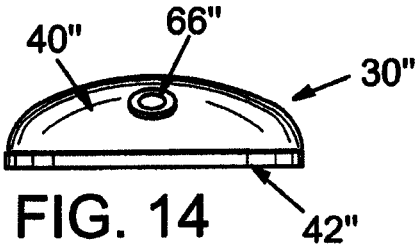
FIG. 14 is a rear elevational view of the embodiment of the bottle cap lifter of FIG. 13 looking toward the rear of FIG. 13 (looking down toward the top of FIG. 13).
Figure 15:
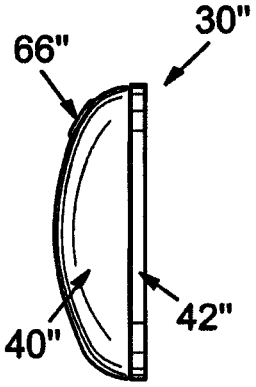
FIG. 15 is a side elevational view of the embodiment of the bottle cap lifter of FIG. 13 looking toward the left side of FIG. 13.
Figure 13:
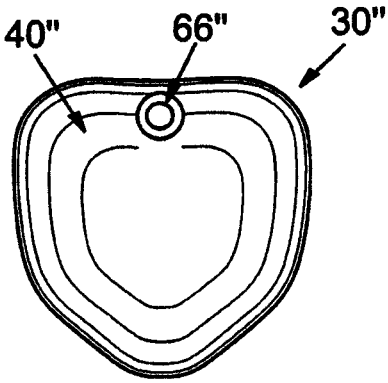
FIG. 13 is a top view of the bottle cap lifter embodiment of FIG. 11.
Figure 16:
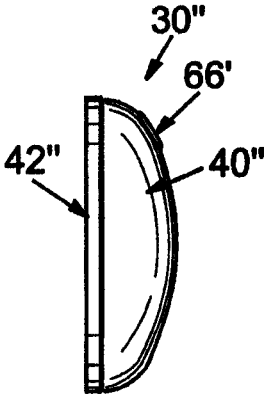
FIG. 16 is a side elevational view of the embodiment of FIG. 13 looking toward the right of FIG. 13.
Figure 17:
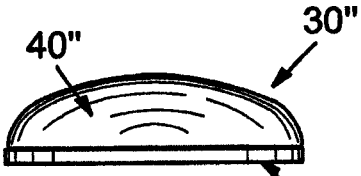
FIG. 17 is a front elevational view of the embodiment of the bottle cap lifter of FIG. 13 (looking upwardly toward the bottom of FIG. 13).

In these latter figures, FIG. 11 illustrates a perspective view of the alternative embodiment of bottle cap lifter, FIG. 12 illustrates the bottom view of this bottle cap lifter, FIG. 13 illustrates a top view of this bottle cap lifter embodiment, FIG. 14 illustrates a rear view of this embodiment, FIG. 17 illustrates a front view of this embodiment, and FIGS. 15 and 16 illustrate respective left and right side views of this embodiment.

Having illustrated and described the principles of my invention with reference to a number of illustrative embodiments, it should be apparent to those of ordinary skill in the art that these embodiments may be modified in arrangement and detail without departing from the inventive principles disclosed herein. I claim as my invention all such modifications as fall within the scope of the following claims.

I claim:

1. A bottle cap lifter for lifting a bottle cap from a bottle, the bottle cap having an exposed surface and a peripheral bottle cap edge, the bottle cap lifter comprising:

a body comprising a first body surface with a peripheral rim bounding at least a portion of a recess extending into the first body surface, the body comprising a second body surface opposed to the first body surface, the second body surface being in a fixed position relative to the first body surface and at least a portion of the second body surface being positioned above and overlying the recess when the first body surface is oriented to face downwardly;

a lever including first and second lever end portions and first and second opposed lever surfaces, the first lever end portion comprising a distal end;

a pivot coupled to the body and to the lever and positioned to pivot the lever to the body at a location adjacent to the first lever end portion and spaced from the distal end of the first lever end portion such that the lever is pivotal about a pivot axis between a first lever position and plural second lever positions, wherein in the first lever position at least a portion of the second lever end portion is overlaid by portions of the first and second body surfaces, and wherein in the second lever position said at least a portion of the second lever end portion extends outwardly from the body and a bottle cap engaging portion of the first lever end portion is overlaid by a portion of the recess and the recess is overlaid by a portion of the second body surface, wherein in the second lever position the bottle cap engaging portion of the first lever end portion is spaced from the first body surface by the recess so as to allow the positioning of a portion of the peripheral bottle cap edge between the bottle cap engaging portion of the first lever end portion and the first body surface such that the bottle cap engaging portion of the first lever end portion is positioned to engage a portion of the peripheral bottle cap edge when the bottle cap is inserted into the recess and between the first body surface and the bottle cap engaging edge portion with a portion of the peripheral rim engaging the exposed surface of the bottle cap.

2. A bottle cap lifter according to claim 1 wherein the peripheral rim is planar, the first lever surface is planar, and wherein the peripheral rim and first lever surface face one another when the lever is in the first lever position, and wherein the pivot extends through the recess, through the first and second body surfaces and through the lever and defines a pivot axis about which the lever pivots that is perpendicular to the plane of the first lever surface.

3. A bottle cap lifter according to claim 2 wherein the first lever surface and peripheral rim are planar surfaces that slide relative to one another as the lever is pivoted.

4. A bottle cap lifter according to claim 3 wherein the first lever surface entirely covers the recess and engages the peripheral rim when the lever is in the first position.

5. A bottle cap lifter according to claim 1 wherein the first lever surface and peripheral rim abut one another when the lever is in the first position.

6. A bottle cap lifter according to claim 1 wherein the body and lever are sized such that the bottle cap engaging portion of the first lever end portion and the portion of the peripheral rim furthest from the bottle cap engaging portion of the first lever end portion are on opposite sides of a longitudinal center line of the bottle.

7. A bottle cap lifter according to claim 1 wherein the recess comprises a hollow interior portion of the body and the lever comprises a cover sized to cover and entirely close the recess when the lever is in the first position.

8. A bottle cap lifter according to claim 1 wherein the body is a one piece body and wherein the lever comprises a planar plate with the first lever surface having substantially the same area as the first body surface.

9. A bottle cap lifter according to claim 8 wherein the pivot axis is perpendicular to the first lever surface and the bottle cap lifter only has one pivot.

10. A bottle cap lifter according to claim 9 wherein the body and lever are pivoted together by a pivot that is a rivet.

11. A bottle cap lifter according to claim 10 wherein the body and lever each comprise a respective opening, and wherein the rivet is hollow and open at each end such that an elongated component is insertable through the opening through the body, the rivet and the opening through the lever.

12. A bottle cap lifter for lifting a bottle cap from a bottle, the bottle cap having an exposed surface and a peripheral bottle cap edge, the bottle cap lifter comprising:

a one-piece body comprising a first body surface including a peripheral body edge portion, the first body surface comprising a bottle cap receiving recess, the body comprising a second body surface opposed to the first body surface and overlaying at least a portion of the recess;

a lever comprising first and second lever end portions and a first lever surface extending between the first and second lever end portions, a pivot coupled to the body and to the lever to pivot the lever to the body so as to pivot about a first pivot axis between first and second lever positions, wherein in the first lever position the lever is pivoted such that the first lever surface is substantially overlaid by the first body surface, and wherein in the second lever position the lever is pivoted such that the second lever end portion projects outwardly from the body and a bottle cap engaging portion of the first lever end portion overlays a portion of the bottle cap engaging recess, whereby an edge of a bottle cap is insertable into the recess such that the cap engaging portion of the first lever end portion catches a portion of the bottle cap edge and a portion of the peripheral body edge portion engages the exposed surface of the bottle cap such that the application of force by the cap engaging edge portion to the caught edge of the bottle cap lifts the bottle cap from the bottle.

13. A bottle cap lifter according to claim 12 wherein the first lever surface and peripheral body edge portion are planar surfaces that face one another and slide relative to one another as the lever is pivoted to the first lever position.

14. A bottle cap lifter according to claim 12 wherein the peripheral body edge portions extend entirely around the recess and wherein the first lever surface entirely covers the recess and engages the peripheral body edge portion about the entire recess when the lever is in the first position.

15. A bottle cap lifter according to claim 12 wherein the recess comprises a hollow interior portion of the body and the lever comprises a cover sized to cover and entirely close the recess when the lever is in the first position.

16. A bottle cap lifter according to claim 12 wherein the first lever surface is planar and wherein the first pivot axis is perpendicular to the first lever surface, and wherein the first pivot axis extends through the recess.

17. A bottle cap lifter according to claim 12 wherein the body and lever are pivoted together by a rivet, wherein the body and lever each comprise a respective opening, and wherein the rivet is hollow and open at each end such that an elongated component is insertable through the opening through the body, the rivet and the opening through the lever.

18. A bottle cap lifter for lifting a bottle cap from a bottle, the bottle cap having an exposed surface and a peripheral bottle cap edge, the bottle cap lifter comprising:

a one-piece body comprising first and second body surfaces, the first body surface having a recess therein that extends into the body, the body having a peripheral rim bounding at least a portion of the recess, the body comprising a second body surface opposed to the first body surface that overlies the recess;

a lever including first and second lever end portions and first and second opposed lever surfaces, the first lever end portion comprising a distal end;

a pivot coupled to the body and to the lever to pivot the lever to the body at a location adjacent to the first lever end portion and spaced from the distal end of the first lever end portion such that the lever is pivotal about a pivot axis between a first lever position and plural second lever positions, wherein the pivot axis extends through the recess, wherein in the first lever position at least a portion of the second lever end portion is overlaid by the first body surface, and wherein in the second lever position said at least a portion of the second lever end portion extends outwardly from the body and a bottle cap engaging portion of the first lever end portion is overlaid by a portion of the recess with space being provided by the recess between the first body surface and the bottle cap engaging portion of the lever to position a portion of the bottle cap peripheral edge in the recess between the bottle cap engaging portion of the lever and a portion of the first body surface, such that the bottle cap engaging portion of the first lever end portion is positioned to extend into the recess and engage a portion of the peripheral bottle cap edge when the bottle cap is inserted into the recess and between the first body surface and the bottle cap engaging edge portion and with a portion of the peripheral rim engaging the exposed surface of the bottle cap;

wherein the peripheral rim is planar, the first lever surface is planar, and wherein the peripheral rim and first lever surface face one another when the lever is in the first lever position;

wherein the first lever surface and peripheral rim are planar surfaces that slide relative to one another as the lever is pivoted;

wherein the first lever surface faces the recess and the peripheral rim and covers the recess and engages the peripheral rim when the lever is in the first position;

wherein the first lever surface and peripheral rim abut one another when the lever is in the first position; and wherein the recess comprises a hollow interior of the body and the lever comprises a cover sized to cover and entirely close the recess when the lever is in the first position.

19. A bottle cap lifter according to claim 18 wherein the lever comprises a planar plate having a first lever surface that has substantially the same area and shape as the first body surface, and wherein the pivot axis is perpendicular to the first lever surface.

20. A bottle cap lifter according to claim 19 wherein the body and lever are pivoted together by a rivet, and wherein the body and lever each comprise a respective opening, and wherein the rivet is hollow and open at each end such that an elongated component is insertable through the opening through the body, the rivet and the opening through the lever.

21. A bottle cap lifter according to claim 1 wherein the peripheral rim is annular.

22. A bottle cap lifter according to claim 1 wherein the recess is bounded by the first body surface and peripheral rim that extends entirely around the recess.

23. A bottle cap lifter according to claim 12 wherein the first pivot axis extends through the recess, wherein the first lever surface is planar and wherein the first pivot axis is perpendicular to the first lever surface.

* * * * *